US007314356B2

(12) United States Patent
Ogawa et al.

(10) Patent No.: US 7,314,356 B2
(45) Date of Patent: Jan. 1, 2008

(54) FLUID MACHINE

(75) Inventors: Hiroshi Ogawa, Nagoya (JP); Tadashi Hotta, Okazaki (JP); Shigeki Iwanami, Okazaki (JP); Keiichi Uno, Kariya (JP)

(73) Assignees: Nippon Soken, Inc., Nishio (JP); DENSO CORPORATION, Kariya (JP)

( * ) Notice: Subject to any disclaimer, the term of this patent is extended or adjusted under 35 U.S.C. 154(b) by 79 days.

(21) Appl. No.: 11/073,599

(22) Filed: Mar. 8, 2005

(65) Prior Publication Data

US 2005/0214148 A1 Sep. 29, 2005

(30) Foreign Application Priority Data

Mar. 24, 2004 (JP) ..... 2004-087740
Jan. 11, 2005 (JP) ..... 2005-004449

(51) Int. Cl.
*F01C 1/04* (2006.01)
*F04C 18/04* (2006.01)

(52) U.S. Cl. ..... 418/55.2; 418/55.4

(58) Field of Classification Search ..... 418/55.2, 418/55.4, 55.6, 142, 143
See application file for complete search history.

(56) References Cited

U.S. PATENT DOCUMENTS 5,127,809 A * 7/1992 Amata et al. ..... 418/55.2
5,722,257 A 3/1998 Ishii et al.
5,775,888 A * 7/1998 Sakamoto et al. ..... 418/55.2
5,938,417 A * 8/1999 Takao et al. ..... 418/55.2
6,234,400 B1 * 5/2001 Guyer ..... 237/12.1
6,321,564 B1 * 11/2001 Yamanaka et al. ..... 62/510
6,464,479 B1 * 10/2002 Saunders ..... 418/55.3
2002/0057976 A1 * 5/2002 Kimura et al. ..... 418/55.2
2003/0115877 A1 * 6/2003 Bara et al. ..... 60/620
2004/0184923 A1 * 9/2004 Iwanami et al. ..... 417/221
2004/0231331 A1 11/2004 Iwanami et al.
2004/0250556 A1 * 12/2004 Sienel ..... 62/88
2005/0193734 A1 * 9/2005 Iwanami et al. ..... 60/657

FOREIGN PATENT DOCUMENTS

JP A-S63-096449 4/1988
JP 03088984 A * 4/1991

OTHER PUBLICATIONS

U.S. Appl. No. 11/063,879, filed Feb. 24, 2005, Iwanami et al.

(Continued)

*Primary Examiner*—Thomas Denion
*Assistant Examiner*—Mary A Davis
(74) *Attorney, Agent, or Firm*—Posz Law Group, PLC

(57) ABSTRACT

An outer end of a seal element for a fixed scroll is extended to a position close to an end of an inside spiral wall of the fixed scroll, and an outwardly extended portion is formed at an outer periphery of a disc-shaped base plate of a movable scroll, so that a bottom surface of the movable scroll is always kept in a sliding contact entirely with the seal element during the orbital movement of the movable scroll. A thickness of the outwardly extended portion formed at the outer periphery of the disc-shaped base plate is made smaller than that of the disc-shaped base plate, so that the weight of the fluid machine can be smaller.

4 Claims, 7 Drawing Sheets

OTHER PUBLICATIONS

Office Action from German Patent Office issued on Sep. 20, 2006 for the corresponding German patent application No. 05 013 267.7 (a copy and English translation thereof).

Chinese Office Action dated Apr. 20, 2007 in the corresponding Chinese application No. 200510056309.3 with an English translation.

* cited by examiner

FLUID MACHINE

CROSS REFERENCE TO RELATED APPLICATION

This application is based on Japanese Patent Application Nos. 2004-87740 filed on Mar. 24, 2004 and 2005-4449 filed on Jan. 11, 2005, the disclosures of which are incorporated herein by reference.

FIELD OF THE INVENTION

The present invention relates to a fluid machine for converting energy of working fluid into mechanical rotational force. The fluid machine according to the present invention is an expansion and compression device to be used in a Rankine cycle for collecting heat energy, wherein the fluid machine has a pump mode operation for compressing and discharging the working fluid, and a motor mode operation for converting fluid pressure into kinetic energy to obtain the mechanical rotational force.

BACKGROUND OF THE INVENTION

In a prior art fluid machine, for example shown in Japanese (Non-examined) Patent Publication S63-96449, heat energy is collected by Rankine cycle, wherein a compressor is also used as an expansion device for converting the collected heat energy into mechanical rotational force.

The applicant of the present invention has applied for a patent application in Japan under Japanese Patent Application No. 2003-141556, in which the scroll type fluid machine is proposed to perform compression and expansion of working fluid by rotating the fluid machine in a forward and backward direction. The fluid machine is used for an air conditioning apparatus for a motor vehicle, in which a refrigerating cycle is also used as a Rankine cycle for collecting waste heat from an engine.

The fluid machine has a pump mode function for compressing working fluid when it is driven by a driving force from an engine or an electric motor, or from both of them, and further a motor mode function for performing an expansion movement when it receives energy from the working fluid.

The compressor device of the fluid machine sucks gas-phase refrigerant into working chambers and compresses the same by decreasing the working chambers to discharge a compressed refrigerant when it receives a driving force from an outside energy source, whereas the expansion device increases the working chambers by introducing expanding the high-pressure gas in the working chamber to generate mechanical energy.

FIG. 12 is a pressure-enthalpy diagram showing a change of state of the working fluid (refrigerant) in the pump mode (compression) and motor mode (expansion) operations. As seen from FIG. 12, the change of state is different from each other due to the compression and expansion of the refrigerant. When the scroll type compression device is used as the expansion device, there is a problem in that the fluid machine can not perform the expansion operation at its maximum efficiency.

When the scroll type fluid machine is operated as the compression device, the working fluid is sucked from an outside portion of scroll wraps and compresses the working fluid. In this operation, an outside working chamber immediately starts its compression when the working chamber is closed. At the starting period of the compression, since there is a little pressure difference between the working chamber and the outside thereof, the working fluid is hardly leaked from the working chamber.

On the other hand, when the scroll type fluid machine is operated as the expansion device, the high pressure working fluid is introduced into an inside working chamber and expanded outwardly along the orbital movement of a movable scroll. When the working chamber reaches at its end stroke (comes to its outermost working chamber position), the pressure of the working fluid has still a certain high amount and therefore is likely to be leaked from the working chamber.

As above, when the scroll type fluid machine is used as the expansion device, it is important to keep a high sealing effect at outer portions of scroll wraps. It is preferable to extend, as long as possible, a seal element to be provided at a front end of the scroll wrap of a fixed scroll to increase the sealing effect. When the seal element is extended longer, then it becomes necessary to make a movable scroll larger so that an outer end portion of the seal element may not be brought out of contact from a bottom surface of the movable scroll.

This is because the outer end portion of the seal element may be damaged by the movable scroll, when the seal element becomes out of contact with the bottom surface of the moving scroll in accordance with a rotation (orbital movement) of the movable scroll and is brought into contact again with the movable scroll when it is further rotated.

SUMMARY OF THE INVENTION

It is, therefore, an object of the present invention, in view of the above mentioned problems, to provide a fluid machine which increases a sealing effect of scroll wraps, in particular a sealing effect at outer portions of the scroll wraps, when it is operated as an expansion device, while an increase of size and weight of the fluid machine is suppressed.

A scroll type fluid machine according to the present invention has a fixed scroll and a movable scroll operatively coupled with each other to form working chambers, wherein the movable scroll is rotated with an orbital movement so that the volume of the working chamber is increased or decreased in accordance with the orbital movement of the movable scroll. Each of the fixed and movable scrolls has a spiral scroll wraps and a seal element is provided at a front end of the scroll wrap, wherein each of front ends are opposed to each bottom surface of the scrolls.

According to a feature of the present invention, an outer end of the seal element for the fixed scroll is extended to a position close to an end of an inside spiral wall of the fixed scroll, and an outwardly extended portion is formed at an outer periphery of a disc-shaped base plate of the movable scroll, so that the bottom surface of the movable scroll is always kept in a sliding contact entirely with the seal element during the orbital movement of the movable scroll.

According to another feature of the present invention, an outer shape of the movable scroll is formed with an envelope curve, which is relatively described on the bottom surface of the movable scroll by an outer edge of the seal element of the fixed scroll, when the movable scroll is rotated. With such an arrangement of the outer shape, the fluid machine can be made smaller in size and lighter in weight.

According to a further feature of the present invention, a thickness of the outwardly extended portion formed at the outer periphery of the disc-shaped base plate is made smaller than that of the disc-shaped base plate, so that the weight of the fluid machine can be smaller.

According to a further feature of the present invention, the disc-shaped base plate of the movable scroll has a diameter enough to always keep a bottom surface of the movable scroll in a sliding contact entirely with the seal element of the fixed scroll during the orbital movement of the movable scroll, and such an outer portion of the disc-shaped base plate, which does not come in contact with any portion of the seal element of the fixed scroll during the orbital movement of the movable scroll, is cut out.

BRIEF DESCRIPTION OF THE DRAWINGS

The above and other objects, features and advantages of the present invention will become more apparent from the following detailed description made with reference to the accompanying drawings. In the drawings:

FIGS. 4A to 4C show a movable scroll of the fluid machine according to the first embodiment, wherein FIG. 4A is a plan view when viewed from a left side, FIG. 4B is a cross sectional view taken along a line IVB-IVB in FIG. 4A, and FIG. 4C is a plan view when viewed from a right side;

DETAILED DESCRIPTION OF THE PREFERRED EMBODIMENTS

First Embodiment

A first embodiment of the present invention will now be explained with reference to FIG. 1. A fluid machine 10 of the present invention is used to, for example, a gas compression type refrigerating machine for a Rankine cycle for a motor vehicle. The gas compression type refrigerating machine for the Rankine cycle collects energy from waste heat generated by an internal combustion engine 20, which generates a driving force for the motor vehicle. In addition, in the fluid machine 10 of the present invention, the heat generated by the fluid machine is utilized for performing an air-conditioning operation for the motor vehicle.

Figure 1:
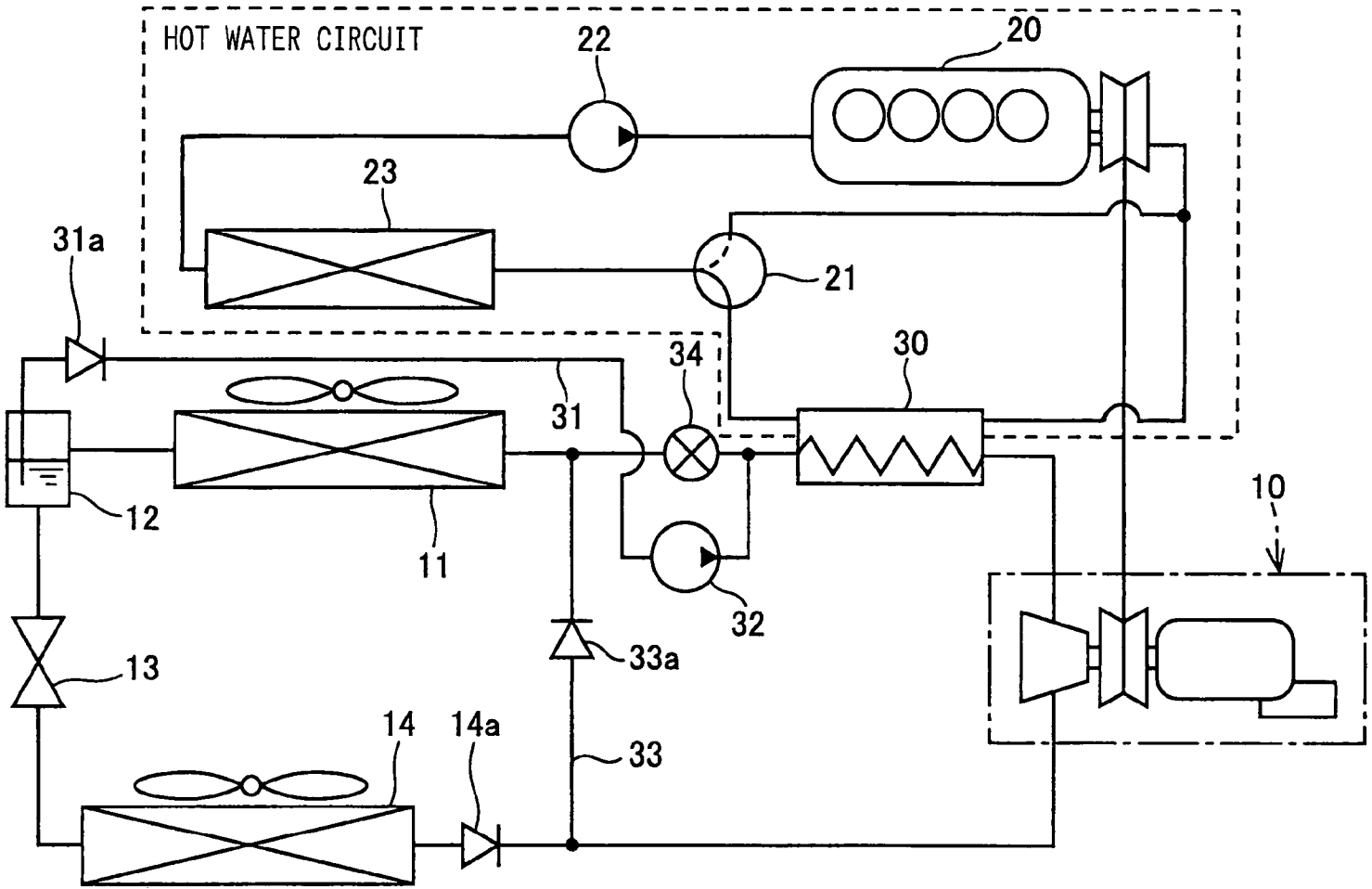
FIG. 1 is a schematic diagram showing a refrigerating cycle and a waste heat collecting cycle to which a fluid machine according to the present invention is applied.

In FIG. 1, a reference numeral 10 designates the fluid machine comprising an expansion-and-compressor device, so that the fluid machine operates as a compressor for compressing a gas-phase refrigerant (this is referred to as a pump mode operation) and also as a power generator for generating a mechanical driving force by converting fluid pressure of superheated steam into kinetic energy (this is referred to as a motor mode operation). A reference numeral 11 designates a heat radiating device connected to an outlet side (a high pressure port 110 described later) of the fluid machine 10 for cooling down the refrigerant gas by heat radiation (The heat radiating device 11 will be also referred to as a condenser).

A reference numeral 12 designates a receiver for dividing the refrigerant from the condenser 11 into a gas-phase refrigerant and a liquid-phase refrigerant. A reference numeral 13 is an expansion valve of a temperature-dependant type for expanding and decreasing the pressure of the liquid-phase refrigerant from the receiver 12, more particularly for decreasing the pressure of the refrigerant in an isenthalpic manner and controlling an opening degree of a passage for the refrigerant so that the degree of superheat of the refrigerant to be sucked into the fluid machine 10 will be maintained at a predetermined value when the fluid machine 10 is operating in the pump mode operation.

A reference numeral 14 designates a heat absorbing device (also referred to as an evaporator) for evaporating the refrigerant from the expansion valve 13 and thereby absorbing heat. The above fluid machine 10, the condenser 11, the receiver 12, the expansion valve 13 and the evaporator 14 constitute a refrigerating cycle for transmitting the heat from a low temperature side to a high temperature side.

A heating device 30 is disposed in a refrigerant passage connected between the fluid machine 10 and the condenser 11 and heats the refrigerant flowing through the refrigerant passage by heat-exchanging the refrigerant with engine cooling water flowing through the heating device 30. A switching valve 21 of a three-way valve is provided in a circuit for the engine cooling water, so that the flow of the cooling water through the heating device 30 is switched on and off. The switching valve 21 is operated by an electronic control unit (not shown).

A first by-pass passage 31 is connected between the receiver 12 and the heating device 30 so that the liquid-phase refrigerant will flow from the receiver 12 to an inlet side of the heating device 30 when a liquid pump 32 is operated. A check valve 31*a* is provided in this first by-pass passage so that only the flow of the refrigerant from the receiver 12 to the heating device 30 is allowed. The liquid pump 32 in this embodiment is an electrically driven pump, which is also operated by the electronic control unit (not shown).

A second by-pass passage 33 is connected between the outlet side (a low pressure port 111 described later) of the fluid machine 10 and the inlet side of the condenser 11 and a check valve 33*a* is disposed in this passage, so that the refrigerant is allowed to flow from the fluid machine 10 to the condenser 11, only when the fluid machine 10 is operated in the motor mode operation.

A check valve 14*a* is provided in the refrigerating cycle so that the refrigerant is allowed to flow from the outlet side of the evaporator 14 to the inlet side (the low pressure port 111) of the fluid machine 10 when the fluid machine 10 is operated in the pump mode operation. An ON-OFF valve 34 is of an electromagnetic type for opening and closing the passage for the refrigerant cycle, wherein the ON-OFF valve 34 is controlled by the electronic control unit (not shown).

A water pump 22 circulates the engine cooling water, and a radiator 23 is a heat exchanger for heat-exchanging the heat of the engine cooling water with the ambient air to cool down the engine cooling water. Although the water pump 22 in this embodiment is a mechanical type pump driven by a driving power from the engine 20, an electrically driven pump can be used instead of the mechanical type pump 22. A by-pass passage for by-passing the radiator 23 and a valve for controlling an amount of the engine cooling water flowing through the radiator 23 are omitted in FIG. 1.

Figure 2:
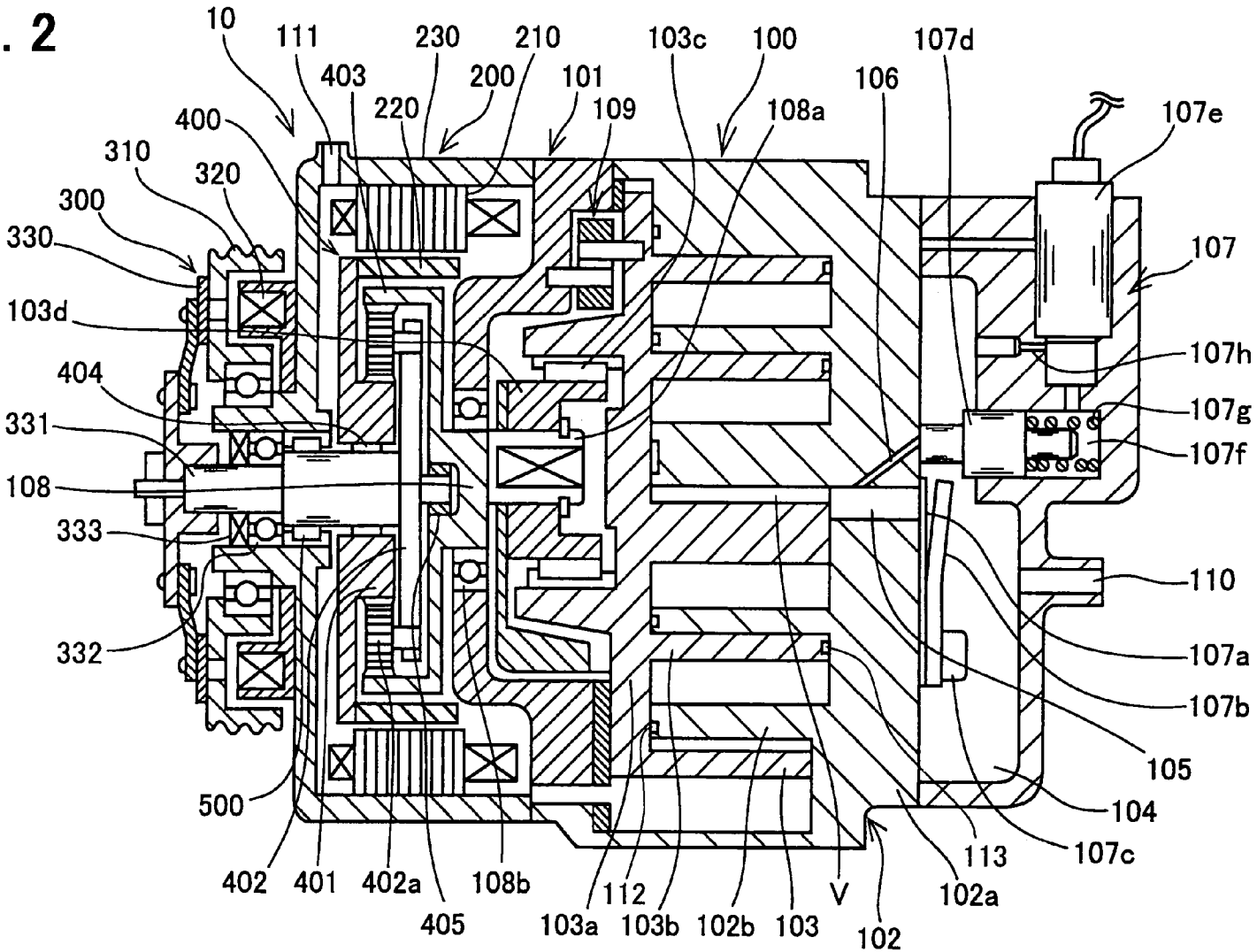
FIG. 2 is a cross-sectional view of a fluid machine according to a first embodiment of the present invention.

Now, the fluid machine 10 will be explained with reference to FIG. 2. The fluid machine 10 according to the embodiment comprises the expansion-and-compressor device 100 for selectively expanding or compressing the refrigerant (the gas-phase refrigerant in this embodiment), an electric rotating device 200 for generating an electric power when a rotational force is applied thereto and for generating a rotational force when the electric power is applied thereto, an electromagnetic clutch 300 for controlling (switching on and off) a drive train of a rotational force from the engine 20 to the expansion-and-compressor device 100, and a transmission device 400 comprising a planetary gear drive for changing a path for the drive train among the expansion-and-compressor device 100, the electric rotating device 200 and the electromagnetic clutch 300 and for increasing and decreasing the rotational speed to be transmitted.

The electric rotating device 200 comprises a stator 210 and a rotor 220 rotating within a space of the stator 210, wherein a winding is wound on the stator 210 and a permanent magnet is fixed to the rotor 220. When the electric power is supplied to the stator 210, the rotor 220 will be rotated to operate as an electric motor so that it drives the expansion-and-compressor device 100, whereas it will operate as an electric power generator when a rotational force is applied to the rotor 220.

The electromagnetic clutch 300 comprises a pulley 310 to be connected to the engine 20 via a V-belt, an electromagnetic coil 320 and a friction plate 330 which will be displaced by an electromagnetic force generated at the electromagnetic coil 320 when it is energized. The coil 320 will be energized when the rotational force from the engine 20 will be transmitted to the fluid machine 10, and the supply of the electric power to the coil 320 will be cut off when the transmission of the rotational force shall be cut off.

The expansion-and-compressor device 100 has the same construction to a well known scroll type compressor, and comprises a middle housing 101 fixed to a stator housing 230 of the electric rotating device 200, a fixed scroll 102 connected to the middle housing 101, and a movable scroll 103 disposed in a space defined by the middle housing 101 and the fixed housing 102. The movable scroll 103 is rotated in the space with an orbit motion to form multiple working chambers V. The device 100 further comprises a high pressure chamber 104, passages 105 and 106 operatively communicating the working chamber V with the high pressure chamber 104, and a valve mechanism 107 for controlling an opening and closing of the passage 106.

The fixed scroll 102 comprises a base plate 102*a* and a spiral scroll wrap 102*b* protruding from the base plate 102*a* towards the middle housing 101, whereas the movable scroll 103 likewise has a base plate 103*a* and a spiral scroll wrap 103*b* protruding from the base plate 103*a* towards the fixed scroll 102, wherein wall portions of the spiral scroll wraps 102*b* and 103*b* are contacted with each other to form the working chambers V. When the movable scroll 103 is rotated, the space of the working chamber V will be expanded or decreased. The details of the fixed and movable scrolls 102 and 103 will be further explained later.

A shaft 108 is rotationally supported by the middle housing 101 and provided with an internal gear 403, which is a part of the transmission device 400. The shaft 108 is further provided with an eccentric shaft 108*a* which is eccentric from a rotational axis of the shaft 108 to operate as a crank arm and operatively connected to the movable scroll 103 over a bush 103*d* and a bearing 103*c*.

Since the bush 103*d* can be slightly displaced with respect to the eccentric shaft 108*a*, the movable scroll 103 is displaced, by reaction force of the compression, in a direction to increase a contact pressure between the scroll wraps 102*b* and 103*b*.

A reference numeral 109 designates an antirotation mechanism for preventing the rotation of the movable scroll 103 and allowing the orbital motion thereof. When the shaft 108 is rotated by one revolution, the movable scroll 103 is moved around the shaft 108 with the orbital motion, and the volume of the working chamber V will be decreased as the working chamber is moved from the outer position to the inner position. The mechanism 109 here comprises a ring and a pair of pins.

The passage 105 operates as an outlet port for pumping out the pressurized refrigerant by communicating the working chamber V, which will reach its minimum volume during the pump mode operation, with the high pressure chamber 104, whereas the passage 106 operates an inlet port for introducing high-temperature and high-pressure refrigerant, namely superheated steam of the refrigerant, from the high pressure chamber 104 into the working chamber V, the volume of which becomes at its minimum value during the motor mode operation.

The high pressure chamber 104 has a function of equalizing the pressure of the refrigerant by smoothing pulsation of the pumped out refrigerant. The high pressure port 110 is formed in a housing forming the high pressure chamber 104 and the port 110 is connected to the heating device 30 and the heat radiating device 11.

The low pressure port 111 is formed in the stator housing 230 for communicating a space defined by the stator housing 230 and the fixed scroll 102 with the evaporator 14 and the second by-pass passage 33.

A discharge valve 107*a* and a valve stopper 107*b* are fixed to the base plate 102*a* of the fixed scroll 102 by a bolt 107*c*, wherein the valve 107*a* is a check valve of a reed valve type for preventing the pumped out refrigerant from flowing back to the working chamber V from the high pressure chamber 104, and the stopper 107*b* is a plate for limiting the movement of the reed valve 107*a*.

A spool 107*d* is a valve for opening and closing the inlet port 106, an electromagnetic valve 107*e* is a control valve for controlling pressure in a back pressure chamber 107*f* by opening and closing a passage between back pressure chamber 107*f* and the high pressure chamber 104 or the space communicated with the low pressure port 111. A spring 107*g* is disposed in the back pressure chamber 107*f* to urge the spool 107*d* in a direction to close the inlet port 106, and an orifice 107*h* having a certain flow resistance is formed in the passage connecting the high pressure chamber 104 with the back pressure chamber 107*f*.

When the electromagnetic valve 107*e* is opened, the back pressure chamber 107*f* is communicated to the space defined by the stator housing 230 (the lower pressure side), then the pressure in the back pressure chamber 107*f* will be decreased lower than that in the high pressure chamber 104 and finally the spool 107*d* will be moved against the spring force of the spring 107*g* in a direction to open the inlet port 106. Since the pressure drop at the orifice 107*h* is so high that an amount of the refrigerant flowing from the high pressure chamber 104 into the back pressure chamber 107*f* is negligible small.

On the other hand, when the electromagnetic valve 107*e* is closed, the pressure in the back pressure chamber 107*f* becomes equal to that in the high pressure-chamber 104 and then the spool 107*d* will be moved in the direction to close the inlet port 106. As above, the spool 107*d*, the electromagnetic valve 107*e*, the back pressure chamber 107*f* and the orifice 107*h* constitute a pilot-type electric valve for opening and closing the inlet port 106.

The transmission device 400 comprises the ring shape internal gear 403 (ring gear), a planetary carrier 402 having multiple (e.g. three) pinion gears 402*a* being engaged with the ring gear 403, and a sun gear 401 being engaged with the pinion gears 402*a*.

The sun gear 401 is integrally formed with the rotor 220 of the electric rotating device 200 and the planetary carrier 402 is integrally fixed to a shaft 331 to which a friction plate 330 is connected. And the ring gear 403 is integrally formed with shaft 108.

A one-way clutch 500 transmits a rotational force from the pulley 310 to the shaft 331, a bearing 332 rotationally supports the shaft 331, a bearing 404 rotationally supports the sun gear 401, namely the rotor 220 with respect to the shaft 331, a bearing 405 rotationally supports the shaft 331 (the planetary carrier 402) with respect to the shaft 108, and a bearing 108*b* rotationally supports the shaft 108 with respect to the middle housing 101.

A rip seal 333 is a seal for preventing the refrigerant from flowing out through a gap between the shaft 331 and the stator housing 230.

The characteristic portion of the present invention is explained with reference the drawings.

Figure 3A:
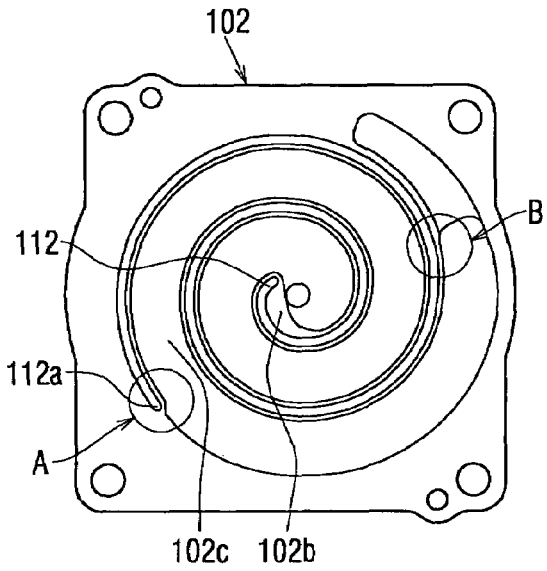
FIG. 3A is a top plan view of a fixed scroll of the fluid machine according to the first embodiment.
Figure 3B:
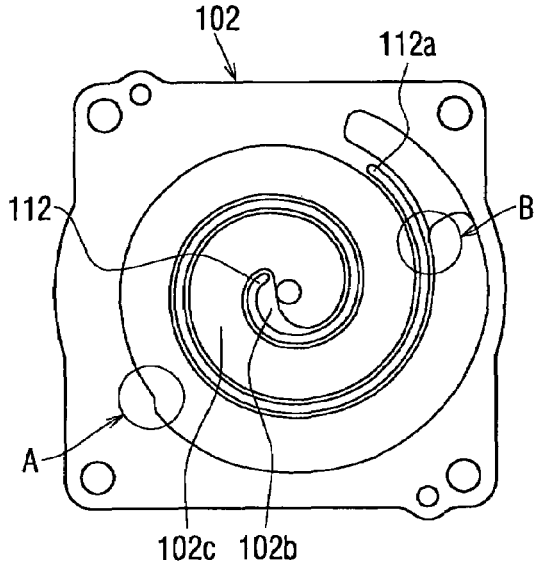
FIG. 3B PRIOR ART
FIG. 3B is a top plan view of a fixed scroll of a conventional scroll type fluid machine.

FIG. 3A is a top plan view of the fixed scroll 102 according to the first embodiment, when viewed from the electric rotating device 200, whereas FIG. 3B is a top plan view of the conventional fixed scroll.

Figure 4A:
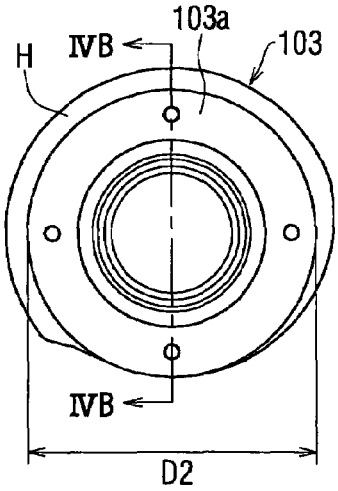
Figure 4B:
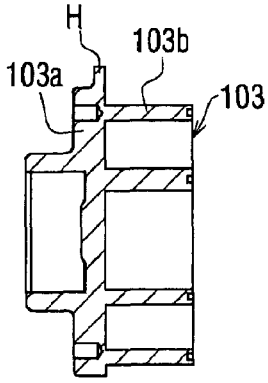
Figure 4C:
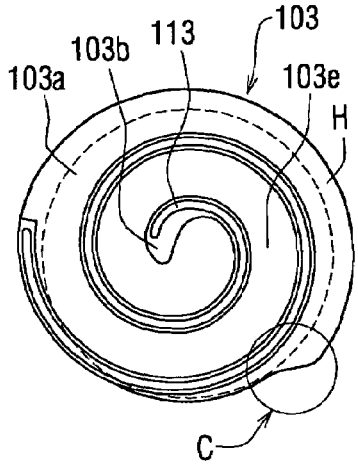
Figure 5A:
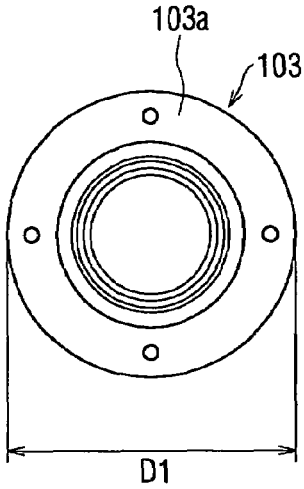
FIG. 5A PRIOR ART
FIGS. 5A to 5C show a movable scroll of the conventional fluid machine, corresponding to FIGS. 4A to 4C.
Figure 5B:
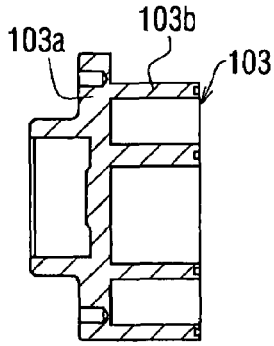
FIG. 5B PRIOR ART
Figure 5C:
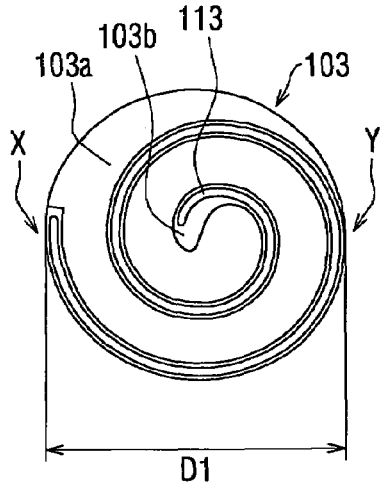
FIG. 5C PRIOR ART

FIGS. 4A to 4C show the movable scroll 103 according to the first embodiment, wherein FIG. 4A is a top plan view when viewed from the electric rotating device 200, FIG. 4B is a cross sectional view, and FIG. 4C is a top plan view when viewed from the fixed scroll 102. FIGS. 5A to 5C show the conventional movable scroll, respectively corresponding to FIGS. 4A to 4C.

As shown in FIG. 3A (and 3B), the fixed scroll 102 is formed with a spiral scroll wrap 102*b*, wherein the spiral scroll wrap 102*b* describes a curving line (an involute curve) starting from an almost center of the fixed scroll to an outer end, so that a spiral space 102*c* is formed.

A chip seal 112 (a seal element) is provided in a spiral groove formed at a front end of the spiral scroll wrap 102*b*. When the movable scroll 103 is assembled to the fixed scroll 102, the spiral scroll wrap 103*b* is housed in the spiral space 102*c* of the fixed scroll 102, to form working chambers V. The chip seal 112 of the fixed scroll 102 is brought into a sliding contact with a bottom surface of a spiral space 103*e* likewise formed in the movable scroll 103, whereas a chip seal 113 provided at a front end of the spiral wrap 103*b* is brought into a sliding contact with a bottom surface of the spiral space 102*c* of the fixed scroll 102. As above, the working chambers V are hermetically sealed.

The scroll wrap 102*b* has an inside wall and an outside wall, each of which is formed with the involute curve. In FIGS. 3A and 3B, a reference "A" designates an end portion of an inside spiral wall of the scroll wrap 102*b* (an end of the inside wall of the involute curve), while a reference "B" designates an end portion of an outside spiral wall of the scroll wrap 102*b* (an end of the outside wall of the involute curve).

In the conventional fixed scroll 102, as shown in FIG. 3B, the chip seal 112 terminates at a portion close to the end portion "B" of the outside spiral wall, wherein a reference 112*a* designates an outer end of the chip seal 112.

In the fixed scroll 102 according to the first embodiment, as shown in FIG. 3A, the chip seal 112 is extended to terminate at such a portion close to the end portion "A" of the inside spiral wall. Namely, the chip seal 112 of the present invention is extended longer by almost 180 degrees, than the chip seal of the conventional fixed scroll.

Figure 7A:
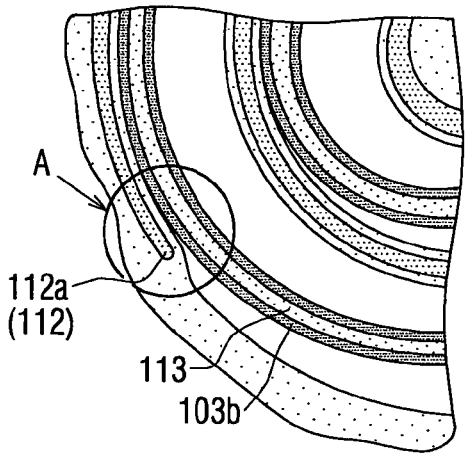
FIGS. 7A to 7D are enlarged views showing movement of the movable scroll with respect to the fixed scroll.
Figure 7B:
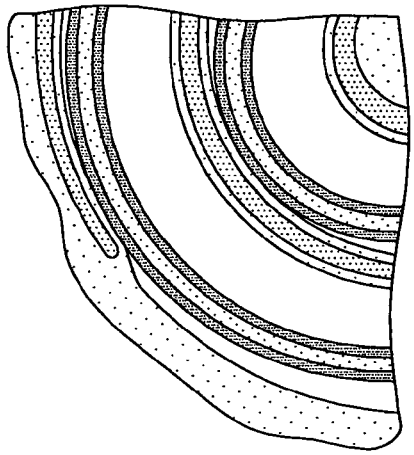
Figure 7C:
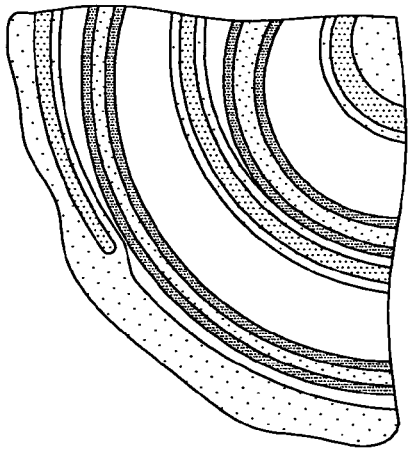
Figure 7D:
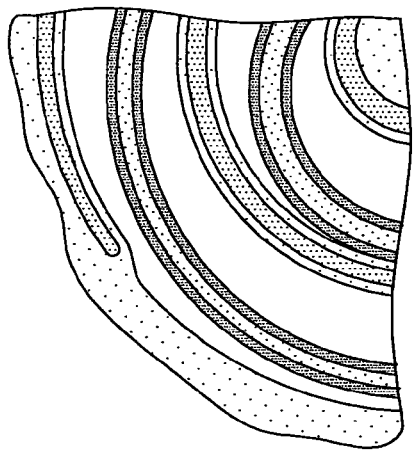

As shown in FIG. 7A, an outer periphery of the scroll wrap 103*b* of the movable scroll 103 is in contact with the inside wall of the scroll wrap 102*b* at the end portion "A" of the inside spiral wall. When the movable scroll 103 is rotated with its orbital movement, the outer periphery of the scroll wrap 103*b* is moved to those positions shown in FIGS. 7B and 7C, and finally moved away from the inside wall of the fixed scroll 102, as shown in FIG. 7D. When the movable scroll 103 is further rotated, then the outer periphery of the scroll wrap 103*b* becomes in contact again with the inside wall of the fixed scroll 102, as shown in FIG. 7A.

As shown in FIGS. 5A to 5C, a disc-shaped base plate 103*a* is made to minimize an outer shape thereof in the conventional movable scroll 103, wherein the disc-shaped base plate 103*a* is formed into an almost disc shape having a diameter "D1" measured in a line connecting a point "X" and a point "Y". The point "X" corresponds to an end of the spiral scroll wrap 103*b*, while the point "Y" corresponds to such a point of the spiral scroll wrap 103*b* which is back-wound by 180 degrees from the point "X".

If the conventional movable scroll 103 shown in FIGS. 5A to 5C was assembled to the fixed scroll 102 of present invention, as shown in FIG. 3A, wherein the chip seal 112 is longer by almost 180 degrees than that of the conventional fixed scroll as explained above, a certain area of the end 112*a* of the chip seal 112 would be brought out of the sliding contact with the bottom surface of the disc-shaped base plate 103*a*, depending on a rotational angle of the orbital movement of the movable scroll 103.

Accordingly, in the conventional fixed scroll 102, as shown in FIG. 3B, the chip seal 112 is terminated at the point close to the end portion "B" of the outside spiral wall, which is shorter by almost 180 degrees than that of the present invention. Namely, the length of the chip seal 112 (the point "B") is shorter by almost 180 degrees than the length of the inside spiral wall (the point "A").

According to the first embodiment of the present invention, therefore, a flanged portion H (an outwardly extended portion) is formed at an outer periphery of the disc-shaped base plate 103*a*, as shown in FIGS. 4A to 4C, so that the end 112*a* of the chip seal 112 can be always kept in the sliding contact with the bottom surface of the disc-shaped base plate 103*a*, at all rotational angle of the orbital movement of the movable scroll 103.

Figure 6:
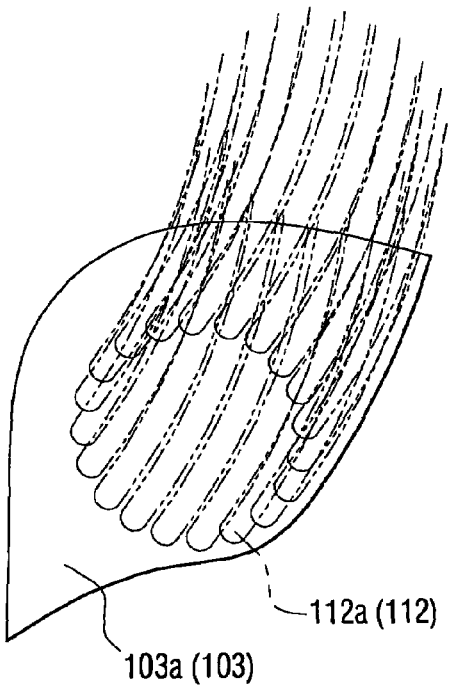
FIG. 6 is an enlarged view of a portion "C" in FIG. 4C, showing an excursion of an end portion of a seal element.

FIG. 6 is an enlarged view of a portion encircled by C in FIG. 4C, in which an excursion of the end 112*a* of the chip seal 112 (which is described in accordance with the orbital movement of the movable scroll 103) with respect to the disc-shaped base plate 103*a* is indicated. FIG. 6 shows the excursion of the end 112*a* with respect to the movable scroll 103 when viewed from the movable scroll 103.

As shown in FIG. 6, an envelope curve described by the end 112*a* of the chip seal 112 corresponds to the orbital movement of the movable scroll 103, and the outer shape of the movable scroll 103 (more particularly, the shape of the flanged portion H formed at the outer periphery of the base plate 103*a*) is so formed that the chip seal 112 (including its end 112*a*) is always in contact with the bottom surface of the movable scroll 103.

A driving center of the movable scroll 103 to be connected to the shaft 108*a* is arranged at such a point, at which a rotational imbalance can be minimized. According to the embodiment, a thickness of the flanged portion H is made smaller than that of the other portion of the base plate 103*a* to keep the rotational imbalance at a minimized amount and also to make the movable scroll 103 lighter in its weight, as shown in FIG. 4B.

An almost disc-shaped base plate 103*a* is formed with a thick portion, having a diameter "D2" (in FIG. 4A), which is made smaller than the diameter "D1" of the conventional movable scroll (in FIG. 5A or 5C). In FIG. 4C, a circle indicated by a dotted line corresponds to an outer periphery of the base plate 103*a* having the thick portion, and therefore an area outside of the circle corresponds to the flanged portion H. As shown in FIG. 4C, a back side of the scroll wrap 103*b* is partly formed with the thin flanged portion H.

Now, an operation of the fluid machine as described above will be explained.

(Air Conditioning Operation)

The air conditioning mode is an operational mode, in which a cooling operation is performed at the evaporator 14 and the heat of the refrigerant is radiated at the condenser 11. In this embodiment, the thermal energy (the cooling energy) generated by the expansion-and-compressor device 100 is utilized for the cooling and defrosting operation for the vehicle with the heat absorbing effect at the evaporator 14. It is, however, also possible to utilize the thermal energy (the heating energy) at the condenser 11 for a heating operation for the vehicle.

In this air conditioning mode, the liquid pump 32 is stopped and the ON-OFF valve 34 is opened so that the refrigerating cycle is operated by the expansion-and-compressor device 100. Furthermore, the engine cooling water bypasses the heating device 30 by the operation of the switching valve 21. The refrigerant flows from the expansion-and-compressor device 100, the heating device 30, the condenser 11, the receiver 12, the expansion valve 13, the evaporator 14 and back to expansion-and-compressor device 100. Since the hot engine cooling water does not flow through the heating device 30, the refrigerant flowing therethrough is not heated, wherein the heating device 30 operates just as a passage for the refrigerant.

The low-pressure refrigerant depressurized at the expansion valve 13 is evaporated by absorbing the heat from the air, which will be blown into the passenger compartment of the vehicle. The vaporized gas-phase refrigerant is sucked into and compressed by the expansion-and-compressor device 100, and then the compressed high temperature refrigerant is cooled down and condensed at the condenser 11.

Although Freon (HFC134a) is used as the refrigerant (working fluid) in this embodiment, any other refrigerant which will be liquidized at a higher pressure side can be used (not limited to HFC134a).

(Waste Heat Collecting Mode)

This is an operational mode in which the air-conditioning operation is stopped, namely the expansion-and-compressor device 100 as the compressor device is stopped, and instead the waste heat from the engine 20 is collected and converted to mechanical energy, wherein the expansion-and-compressor device is operated as the expansion device 100.

In this operational mode, the liquid pump 32 is operated, the ON-OFF valve 34 is closed and the device 100 is operated as the expansion device (motor mode operation). And the engine cooling water from the engine 20 is circulated through the heating device 30 by means of the switching valve 21.

The refrigerant flows in this operational mode from the receiver 12 through the first by-pass passage 31, the heating device 30, the expansion device 100, the second by-pass passage 33, the heat radiating device 11, and back to the receiver 12. The flow of the refrigerant in the heat radiating device 11 is different from that for the pump mode operation.

As above, the superheated steam heated by the heating device 30 flows into the expansion device 100 and expanded therein so that the enthalpy of the refrigerant will be decreased in an isentropic manner. Accordingly, the electric power corresponding to an amount of decrease of the enthalpy will be charged into the battery.

The refrigerant from the expansion device 100 will be cooled down and condensed at the heat radiating device 11 and charged in the receiver 12. Then the liquid-phase refrigerant will be sucked from the receiver 12 by the liquid pump 32 and pumped out to the heating device 30. The liquid pump 32 pumps out the liquid-phase refrigerant at such a pressure that superheated steam at the heating device 30 may not flow in a backward direction.

Figure 8:
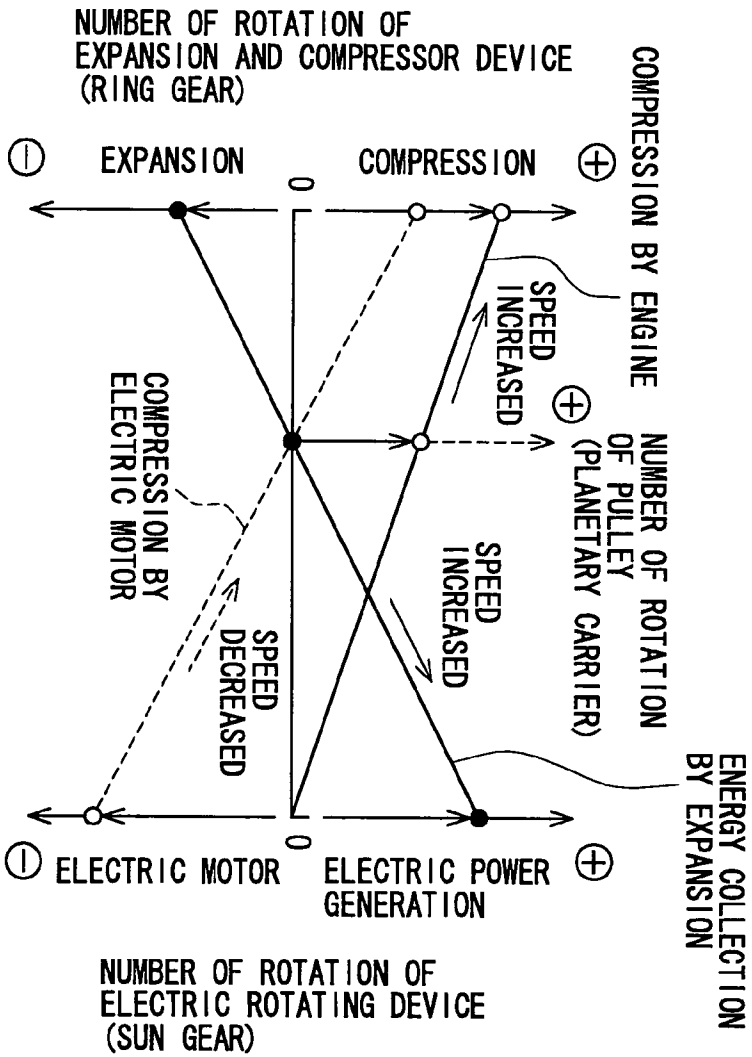
FIG. 8 is a diagram showing operations of the fluid machine according to the present invention.

FIG. 8 is a diagram showing the operation of the fluid machine 10 for the above air-conditioning and waste heat collecting modes.

As explained above, the first embodiment of the present invention has the following advantages.

(1) The sealing performance at the outer portions of the scroll wraps can be increased, and thereby the efficiency of the expansion-and-compressor device 100 is improved, in particular when the device 100 is operated as the expansion device.

The above advantage is achieved by extending the chip seal 112 to the end portion A of the inside spiral wall of the fixed scroll 102 and by outwardly extending the outer periphery of the movable scroll 103, so that the chip seal 112 is always kept in the sliding contact with the surface of the moving scroll 103 during the orbital movement of the movable scroll 103.

(2) The possible increase of the size and weight of the fluid machine 10 can be further suppressed.

The advantage is achieved by forming the outer shape of the movable scroll, in particular the outer shape of the outwardly extended portion (the flanged portion), with the envelope curve which is relatively described by an outer edge of the chip seal 112 of the fixed scroll 102.

(3) A possible pressure loss, when sucking the working fluid into the compressor device 100 or when discharging the working fluid from the expansion device 100, can be suppressed to a smaller value.

This is achieved by increasing the fluid passage behind the movable scroll 103. This is because the diameter of the thick base plate 103*a* of the movable scroll is made smaller than that of the conventional movable scroll.

(4) The rotational weight imbalance during the orbital movement of the movable scroll 103 can be reduced and further the increase of the size and weight of the fluid machine 10 can be suppressed.

This is because that the driving center of the movable scroll 103 to be connected to the shaft 108*a* is arranged at such a point, at which the rotational imbalance is minimized.

(5) The increase of the weight of the fluid machine 10 can be also suppressed.

This is achieved by forming the flanged portion H at the outer periphery of the movable scroll 103, the thickness of which is smaller than the base plate 103*a*.

Second Embodiment

Figure 9A:
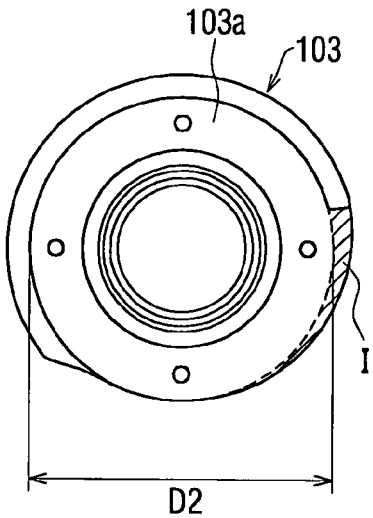
FIGS. 9A to 9C show a movable scroll of the fluid machine according to a second embodiment, corresponding to FIGS. 4A to 4C.
Figure 9B:
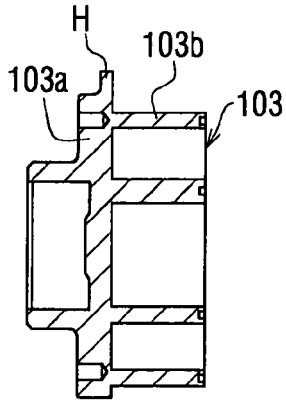
Figure 9C:
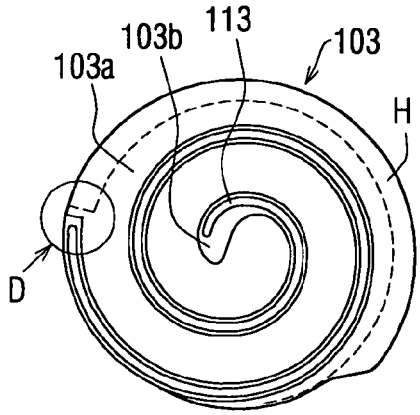

FIGS. 9A to 9C show the movable scroll 103 according to a second embodiment, wherein FIG. 9A is a top plan view when viewed from the electric rotating device 200, FIG. 9B is a cross sectional view, and FIG. 9C is a top plan view when viewed from the fixed scroll 102.

As already explained, according to the first embodiment shown in FIG. 4C, the back side of the scroll wrap 103*b* is partly formed with the thin flanged portion H, because the diameter "D2" of the thick portion is made smaller than the diameter "D1" of the thick portion of the conventional movable scroll shown in FIG. 5A.

According to the second embodiment, a hatched area "I" of the movable scroll 103 is formed with the thick portion, as shown in FIG. 9A, so that all area of the back side of the scroll wrap 103*b* is formed with the thick portion, and only such a portion of the back side, at a front side of which the scroll wrap 103*b* is not formed, is formed with the thin flanged portion H.

With such an arrangement, the scroll wrap 103*b* can be more strongly supported by the base plate 103*a*, and at the same time the weight saving can be likewise achieved.

Third Embodiment

Figure 10A:
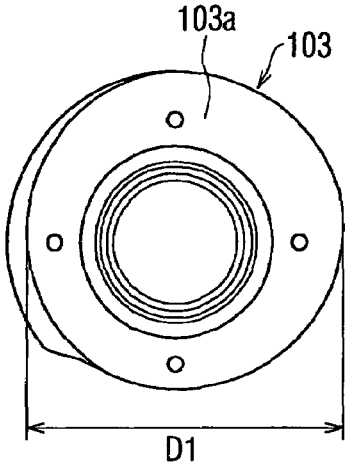
FIGS. 10A to 10C show a movable scroll of the fluid machine according to a third embodiment, corresponding to FIGS. 4A to 4C.
Figure 10B:
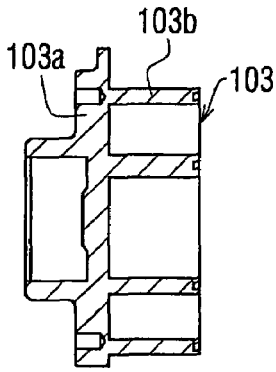
Figure 10C:
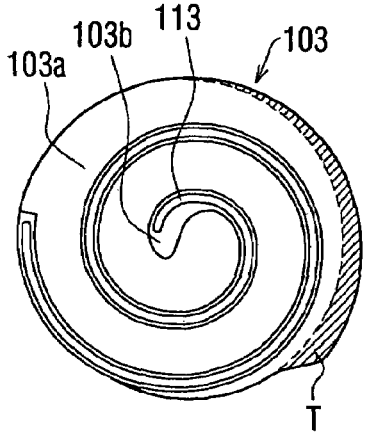

FIGS. 10A to 10C show the movable scroll 103 according to a third embodiment, wherein FIG. 10A is a top plan view when viewed from the electric rotating device 200, FIG. 10B is a cross sectional view, and FIG. 10C is a top plan view when viewed from the fixed scroll 102.

According to the third embodiment, the thick portion of the base plate 103*a* is made to be identical to that of conventional movable scroll, so that the diameter of the thick portion 103*a* is made to be "D1", as shown in FIG. 10A. And a flanged thin portion (an outwardly extended portion) "T" is formed at an outer periphery of the base plate 103*a*. An outer shape of the movable scroll 103 of third embodiment is identical to the first and second embodiment, so that the chip seal 112 is always kept in the sliding contact with the bottom surface of the movable scroll 103. Accordingly, the same sealing effect to the first and second embodiments can be obtained in the third embodiment.

Fourth Embodiment

Figure 11:
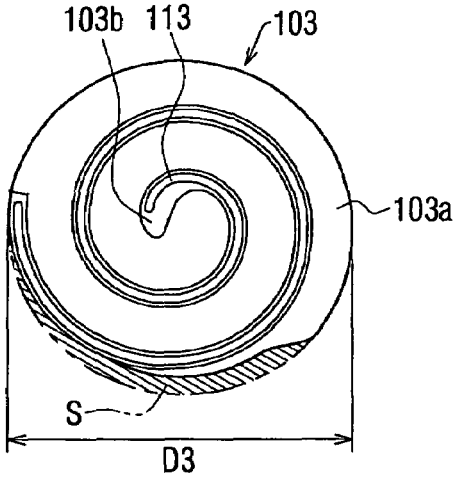
FIG. 11 shows a movable scroll of the fluid machine according to a fourth embodiment, corresponding to FIG. 4C.
Figure 12:
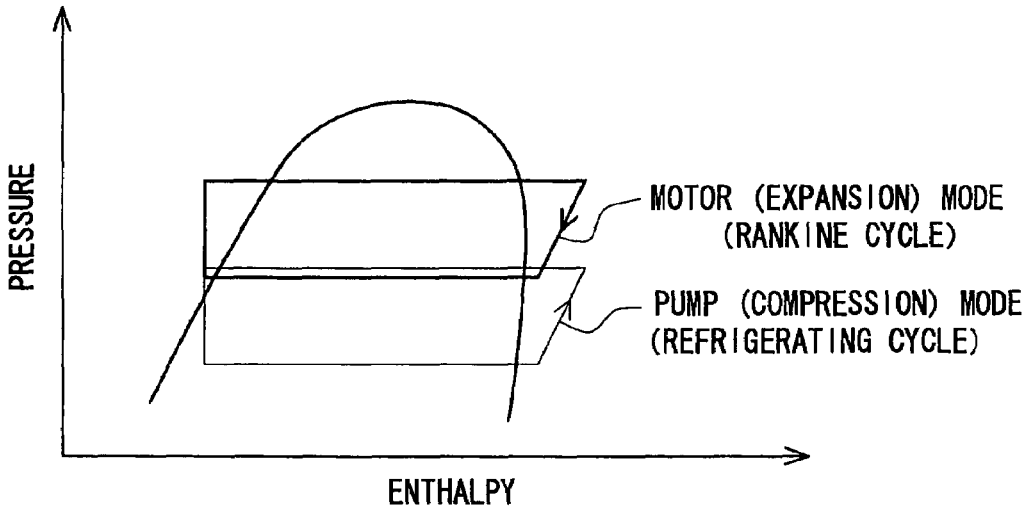
FIG. 12 is a pressure-enthalpy diagram for pump-mode and motor-mode operations of the fluid machine.

FIG. 11 shows the movable scroll 103 according to a fourth embodiment, wherein FIG. 11 is a top plan view when viewed from the fixed scroll 102.

According to the fourth embodiment, the base plate 103*a* of the movable scroll 103 is formed from a disc-shaped thick portion having a diameter "D3", which is larger than the diameter "D1" of the conventional movable scroll, so that a bottom surface of the movable scroll 103 has a sufficient area to always keep the sliding contact with the chip seal 112 of the fixed scroll 102. According to the fourth embodiment, however, a hatched portion "S" is cut out from the base plate 103*a*, since the hatched portion "S" is not necessary to keep the sliding contact between the bottom surface of base plate 103*a* and the chip seal 112 of the fixed scroll 102.

Other Embodiments

In the above first to third embodiments, the outer shape of the base plate (namely, the outer shape of the flanged portion) is preferably formed by the envelope curve, which is described by the scroll wrap 102*b* in response to the orbital movement of the movable scroll 103, so that all portions of the chip seal 112 provided on the fixed scroll 102 is kept in contact with the bottom surface of the movable scroll 103. The outer shape of the base plate (the flanged portion) is, however, not necessarily formed by the envelope curve.

Furthermore, in the above embodiments, the chip seal 112 is extended to the end portion A of the inside spiral wall. The chip seal can be further extended or extended to a half way.

The transmission device 400 of the planetary gear train can be replaced by any kinds of other transmission devices, such as CVT (Continuous Variable Transmission), or a toroidal-type transmission without using belts, and the like.

Although the collected waste heat energy from the engine is converted into the electric power by the expansion-and-compressor device 100 and charged in the battery in the above embodiment, the collected energy can be converted into mechanical energy, for example, into kinetic energy by a flywheel, or into elastic potential energy by springs.

The fluid machine should not be limited to a use for motor vehicles.

What is claimed is:

1. A scroll type fluid machine comprising:

a housing;

a converting means for collecting heat energy from working fluid and converting the collected heat energy into mechanical rotational energy by expanding the working fluid in an isenthalpic manner;

a shaft rotationally supported by the housing and having an eccentric shaft portion;

a movable scroll having a disc-shaped base plate and a spiral wrap, the movable scroll being operatively connected with the eccentric shaft portion so that the movable scroll moves with an orbital movement;

a fixed scroll having a base plate and a spiral wrap to be coupled with the movable scroll to form working chambers, volume of the working chambers being gradually increased when the movable scroll is rotated with its orbital movement and when the working chambers move from a center of the fixed scroll toward an outward direction;

a seal element provided on a front end of the spiral wrap of the fixed scroll, wherein an outer end of the seal element is extended to a position close to an end of an inside spiral wall of the fixed scroll wherein the end of the inside spiral wall corresponds to an outermost wall at which the outside spiral wall of the movable scroll is brought into and out of contact with the inside spiral wall of the fixed scroll in accordance with the orbital movement of the movable scroll; and an outwardly extended portion formed at an outer periphery of the disc-shaped base plate of the movable scroll to form a part of a bottom surface of the disc-shaped base plate, so that the bottom surface of the disc-shaped base plate is always kept entirely in sliding contact with the seal element during the orbital movement of the movable scroll, wherein the thickness of the outwardly extended portion is less than that of the disc-shaped base plate of the movable scroll, wherein an outer shape of the movable scroll is formed with an envelope curve, which is described on the bottom surface of the movable scroll by an outer edge of the seal element, when the movable scroll is rotated.

2. A scroll type fluid machine comprising:

a housing;

a converting means for collecting heat energy from working fluid and converting the collected heat energy into mechanical rotational energy by expanding the working fluid in an isenthalpic manner;

a shaft rotationally supported by the housing and having an eccentric shaft portion;

a movable scroll having a disc-shaped base plate and a spiral wrap, the movable scroll being operatively connected with the eccentric shaft portion so that the movable scroll moves with an orbital movement;

a fixed scroll having a base plate an spiral wrap to be coupled with the movable scroll to form working chambers, the volume of the working chambers being gradually increased when the movable scroll is rotated with its orbital movement and when the working chambers move from a center of the fixed scroll toward an outward direction;

a seal element provided on a front end of the spiral wrap of the fixed scroll, wherein an outer end of the seal element is extended to a position close to an end of an inside spiral wall of the fixed scroll wherein the end of the inside spiral wall corresponds to an outermost wall at which the outside spiral wall of the movable scroll is brought into and out of contact with the inside spiral wall of the fixed scroll in accordance with the orbital movement of the movable scroll; and an outwardly extended portion formed at an outer periphery of the disc-shaped base plate of the movable scroll to form a part of a bottom surface of the disc-shaped base plate, so that the bottom surface of the disc-shaped base plate is always kept entirely in sliding contact with the seal element during the orbital movement of the movable scroll, wherein the thickness of the outwardly extended portion is less than that of the disc-shaped base plate of the movable scroll, wherein a thickness of the outwardly extended portion formed at the outer periphery of the disc-shaped base plate is made smaller than that of the disc-shaped base plate, except for such portions, a front side of which is opposed to the scroll wrap of the fixed scroll.

3. A scroll type fluid machine comprising:

a housing;

a converting means for collecting heat energy from working fluid and converting the collected heat energy into mechanical rotational energy by expanding the working fluid in an isenthalpic manner;

a shaft rotationally supported by the housing and having an eccentric shaft portion;

a movable scroll having a disc-shaped base plate and a spiral wrap, the movable scroll being operatively connected with the eccentric shaft portion so that the movable scroll moves with an orbital movement;

a fixed scroll having a base plate and a spiral wrap to be coupled with the movable scroll to firm working chambers, the volume of the working chambers being gradually increased when the movable scroll is rotated with its orbital movement and when the working chambers move from a center of the fixed scroll toward an outward direction; and a seal element provided on a front end of the spiral wrap of the fixed scroll, wherein an outer end of the seal element is extended to a position close to an end of an inside spiral wall of the fixed scroll, the end of the inside spiral wall corresponds to an outermost wall at which the outside spiral wall of the movable scroll is brought into and out of contact with the inside spiral wall of the fixed scroll in accordance with the orbital movement of the movable scroll, the diameter of the disc-shaped base plate of the movable scroll is such that a bottom surface of the movable scroll is always entirely maintained in sliding contact with the seal element during the orbital movement of the movable scroll, and an outer portion of the disc-shaped base plate, which does not come m contact with any portion of the seal element during the orbital movement of the movable scroll, is cut out.

4. A scroll type fluid machine according to claim 3, wherein the fixed scroll is integrally formed in the housing, a configuration of cross section in a plane perpendicular to the shaft is formed into an almost rectangular shape, and the end of the inside spiral wall of the fixed scroll is located at a position close to a corner of the rectangular-shaped fixed scroll.

* * * * *